US005350038A

United States Patent [19]

Lazarus

[11] Patent Number: 5,350,038

[45] Date of Patent: Sep. 27, 1994

[54] FOLDABLE EXTENSION LADDER AND LADDER SECTIONS THEREFOR

[76] Inventor: Jonathan F. Lazarus, 9 Vinton Ave., Bedford, N.Y. 10506

[21] Appl. No.: 12,264

[22] Filed: Feb. 1, 1993

[51] Int. Cl.[5] ..... E06C 1/12

[52] U.S. Cl. ..... 182/163; 182/207

[58] Field of Search ..... 182/163, 207, 209, 24, 182/23, 27, 164, 152

[56] References Cited

U.S. PATENT DOCUMENTS

| | | | |
|---|---|---|---|
| 745,320 | 12/1903 | Bruno . | |
| 1,177,557 | 3/1916 | White . | |
| 1,350,242 | 8/1920 | Saget | 182/24 |
| 1,359,297 | 11/1920 | Voss . | |
| 2,024,039 | 12/1935 | Harting . | |
| 2,153,362 | 4/1939 | Bonville | 182/209 |
| 2,162,040 | 6/1939 | Webster . | |
| 2,542,398 | 2/1951 | Crumpton . | |
| 2,805,016 | 9/1957 | Brooking et al. . | |
| 3,006,432 | 10/1961 | Gurley . | |
| 3,143,185 | 8/1964 | Wenger . | |
| 3,517,772 | 6/1970 | Weis et al. . | |
| 3,692,143 | 9/1972 | Kummerlin et al. . | |
| 3,811,151 | 5/1974 | Kuemmerlin et al. . | |
| 3,848,699 | 11/1974 | Goodwin | 182/163 |
| 4,067,413 | 1/1978 | Olsen . | |
| 4,102,433 | 7/1978 | Valkenburgh | 182/207 |
| 4,182,431 | 1/1980 | Wing . | |
| 4,216,844 | 8/1980 | Klafs . | |
| 4,376,470 | 3/1983 | Ashton . | |
| 4,407,045 | 10/1983 | Boothe . | |
| 4,448,283 | 5/1984 | Marques . | |
| 4,457,391 | 7/1984 | Marques . | |
| 4,493,392 | 1/1985 | Marques . | |
| 4,574,918 | 3/1986 | Marques . | |
| 4,645,371 | 2/1987 | Wang . | |
| 4,666,327 | 5/1987 | Su . | |
| 4,697,305 | 10/1987 | Boothe . | |
| 4,770,559 | 9/1988 | Yoo . | |
| 4,926,967 | 5/1990 | Baker Mervyn . | |
| 4,951,780 | 8/1990 | Kim . | |
| 5,000,289 | 3/1991 | Sanchez | 182/209 X |
| 5,242,030 | 9/1993 | Lobozzo | 182/163 X |

FOREIGN PATENT DOCUMENTS

| | | | |
|---|---|---|---|
| 83129 | 12/1964 | France | 182/163 |
| 1426678 | 12/1966 | France | 182/24 |

*Primary Examiner*—Alvin C. Chin-Shue
*Attorney, Agent, or Firm*—Richard M. Goldberg

[57] ABSTRACT

A foldable extension ladder includes first and second ladder sections; each ladder section including a three foldable sections, each foldable section including a pair of end rails and a plurality of transverse rungs connecting the pair of end rails in a parallel, spaced apart relation, hinges for hingedly connecting together the three foldable sections in end to end relation for movement between an in-line configuration and a folded configuration in which all of the foldable sections are arranged in a substantially parallel, overlaying relation with each other, each hinge including a pivot pin pivotally connecting ends of two adjacent foldable sections, the pivot pins of all hinges of the first ladder section being arranged to a first side of the first ladder section, when the first ladder section is in the in-line configuration, the pivot pins of all hinges of the second ladder section being arranged to a first side of the second ladder section, when the second ladder section is in the in-line configuration, and a pivoted hook assembly releasably locking each hinge in a fixed position when two foldable sections at opposite ends of each hinge are arranged in the in-line configuration; and the end rails of the first and second ladder sections being slidably connected together in the lengthwise direction of the ladder, at second, opposite sides of the first and second ladder sections such that the first and second ladder sections are fully slidable with respect to each other.

22 Claims, 8 Drawing Sheets

FOLDABLE EXTENSION LADDER AND LADDER SECTIONS THEREFOR

BACKGROUND OF THE INVENTION

The present invention relates generally to ladders, and more particularly, is directed to an extension ladder that is fully foldable into a compact configuration.

A conventional extension ladder includes a lower ladder section and an upper ladder section arranged in parallel, sliding relation to each other. Each ladder section includes two elongated end rails connected together in a parallel, spaced apart relation by a plurality of transverse rungs.

The manner of slidably connecting the first and second ladder sections to each other may take various forms. For example, the upper ladder section may slide within the lower ladder section, as taught by U.S. Pat. No. 3,692,143 to Kummerlin et al and U.S. Pat. No. 4,376,470 to Ashton. Alternatively, the upper ladder section may be connected with the lower ladder section to slide adjacent thereto, for example, as taught by U.S. Pat. No. 745,320 to Bruno and U.S. Pat. No. 2,162,040 to Webster.

A problem, however, with conventional extension ladders is that the ladder sections are generally formed as continuous, non-folding straight sections. As a result, each ladder section has a substantial length. Because of this extensive length, a conventional extension ladder can, for all practical purposes, only be carried by a truck, van or the like. In other words, it is impractical to carry a conventional extension ladder in an automobile or the like.

In an attempt to overcome these shortcomings, foldable ladders, such as those shown in U.S. Pat. No. 3,143,185 to Wenger and U.S. Pat. No. 4,666,327 to Su, have recently gained in popularity. A conventional foldable ladder includes three or more foldable sections that are hinged together in end to end relation. Thus, the foldable sections can be folded between a fully extended position in which the foldable sections are arranged in-line, that is, in the same plane, and a compact storage position in which the foldable sections are provided in parallel, overlaying relation. In addition, various intermediate configurations can be achieved. In order to provide such movement between the in-line configuration and the fully folded configuration in which the foldable sections are provided in parallel, overlaying relation, the hinges are provided in alternating fashion on opposite sides of the ladder, as shown by U.S. Pat. No. 3,517,772 to Weis et al, so that the foldable sections are folded in a zig-zag manner between the fully extended in-line configuration and the compact fully folded storage position.

Although the hinges are conventionally provided in such alternating fashion, U.S. Pat. No. 3,006,432 to Gurley and U.S. Pat. No. 4,666,327 to Su each show a foldable ladder in which the hinges are provided on the same side of the ladder. However, the reason for such arrangement of the hinges is to place the ladder in the shown U-shaped configurations. Thus, all of the foldable sections cannot be folded in a parallel, overlaying relation for compact storage. As a result, transport of the ladder is difficult, since the ladder always occupies a large amount of space.

In any event, all of the aforementioned folding ladders present another problem. Specifically, the number of foldable sections that can be hinged together is limited. This is because, unlike a conventional extension ladder, a foldable ladder only has the thickness of a single ladder section for supporting a person. Thus, the foldable ladder becomes more and more unstable as the length of the foldable ladder increases. In other words, the greater the length of such a foldable ladder, the greater the bending and swaying of the foldable ladder when it is fully extended in the in-line configuration. For this reason, foldable ladders that are now sold are of limited length, for example, twelve to fourteen feet, or the like, which is much less than the length that can be achieved with a conventional extension ladder.

A hybrid ladder is also known, which includes an upper foldable ladder section and at least one lower non-foldable ladder section slidably connected with the upper foldable ladder section. An example of such a hybrid ladder in which the upper ladder section includes two foldable sections is shown in U.S. Pat. No. 4,376,470 to Ashton, while an example of such a hybrid ladder in which the upper ladder section includes four foldable sections is shown in U.S. Pat. No. 2,024,039 to Harting.

However, such a hybrid ladder, while being of a slightly greater length than a conventional foldable ladder, due to the addition of at least one lower non-foldable ladder section, is still limited in its length. This is due to the non-foldable nature of the lower ladder section.

In addition, it will be appreciated that with conventional foldable ladders, the largest bending of the ladder occurs in the middle of the ladder. This is because the lower end of the ladder is in contact with the ground and the opposite upper end of the ladder is in contact with the side of a building. This large bending does not occur with conventional extension ladders due to the fact that the upper and lower ladder sections thereof are connected at the middle of the ladder and thereby provide a double thickness and thereby a reinforcement thereat. With the hybrid ladders, each non-foldable ladder section is connected to a foldable end section of the foldable ladder section, so that, when extended in an in-line arrangement, the middle of the ladder is still of a single thickness, and thereby inherently weak.

OBJECTS AND SUMMARY OF THE INVENTION

Accordingly, it is an object of the present invention to provide a foldable extension ladder that overcomes the problems with the aforementioned prior art.

It is another object of the present invention to provide a foldable extension ladder that can be fully folded into a compact arrangement for easy transport and storage.

It is still another object of the present invention to provide a foldable extension ladder which can be fully extended to operate as a conventional extension ladder.

It is yet another object of the present invention to provide a foldable extension ladder which is reinforced at its center when unfolded to operate as a conventional extension ladder.

It is a further object of the present invention to provide a foldable extension ladder in which each ladder section is formed of a plurality of foldable sections.

It is a still further object of the present invention to provide a foldable extension ladder in which the hinges of each ladder section are arranged on the same side of the respective ladder section to permit full sliding movement of one ladder section relative to the other ladder section.

It is a yet further object of the present invention to provide a foldable extension ladder in which each ladder section can be fully folded into a compact storage configuration while connected with the other ladder section.

It is another object of the present invention to provide a foldable ladder section for a foldable extension ladder in which the hinges thereof are arranged on the same side of the ladder section, with at least one hinge being larger than each other hinge.

It is still another object of the present invention to provide a foldable ladder section for a foldable extension ladder in which the hinges thereof are arranged on the same side of the ladder section, with the hinges sequentially increasing in size.

In accordance with an aspect of the present invention, a ladder section includes at least three foldable sections, each foldable section including a pair of end rails and a plurality of rungs extending in a transverse direction of the ladder section and connecting the pair of end rails in a parallel, spaced apart relation; a plurality of hinges for hingedly connecting together the foldable sections in end to end relation for movement between an in-line configuration in which the foldable sections are arranged substantially in-line with each other along a lengthwise direction of the ladder section and a folded configuration in which all of the foldable sections are arranged in a substantially parallel, overlaying relation with each other, each hinge including a pivot pin for pivotally connecting ends of two adjacent ones of the foldable sections, the pivot pins of all the hinges being arranged to a first side of the ladder section, as measured in a depthwise direction which is substantially perpendicular to the transverse and lengthwise directions, when the ladder section is in the in-line configuration; and a locking pin for releasably locking each hinge in a fixed position when two foldable sections at opposite ends of each hinge are arranged in the in-line configuration. Preferably, there are three foldable sections.

In particular, successive ones of the pivot pins extending in the lengthwise direction of the ladder section, are spaced with an increasing distance away from the ladder section, as measured in the depthwise direction.

Each hinge includes a first hinge plate having a connecting section for connecting the first hinge plate to one end rail of one foldable section, and a pivot connecting portion extending outwardly of the ladder section, as measured in the depthwise direction; a second hinge plate having a connecting section for connecting the second hinge plate to one end rail of another adjacent foldable section, and a pivot connecting portion extending outwardly of the ladder section, as measured in the depthwise direction; a third hinge plate having a connecting section for connecting the third hinge plate to the one end rail of the adjacent foldable section, and a pivot connecting portion extending outwardly of the ladder section, as measured in the depthwise direction, the third hinge plate being in parallel, spaced apart relation to the second hinge plate so as to define a gap therebetween through which the first hinge plate can slide; one pivot pin pivotally connects the pivot connecting portions of the first, second and third hinge plates together.

The first hinge plate includes a first lock opening and the second and third hinge plates each include a second lock opening in alignment with the first lock opening when the ladder section is in the in-line configuration; and the locking pin releasably engages in the first and second lock openings when the ladder section is in the in-line configuration to releasably lock the ladder section in the in-line configuration.

Preferably, a spring biases the pin into engagement with the first and second lock openings, and a holding device can releasably hold the pin out of engagement with the first and second openings against the force of the spring.

The aforementioned first ladder section is combined with a second ladder section of the same construction. The end rails of the first and second ladder sections are slidably connected together in the lengthwise direction of the ladder, at second, opposite sides of the first and second ladder sections, opposite the sides that the hinges extend from, such that the first and second ladder sections are fully slidable with respect to each other.

Specifically, the first ladder section includes a first foldable section, a second foldable section and a third foldable section, hingedly connected together in order, and the second ladder section includes a first foldable section, a second foldable section and a third foldable section, hingedly connected together in order. The third foldable section of the first ladder section is always slidably connected with the first foldable section of the second ladder section.

The pivot pin of each hinge which connects the first foldable section and the second foldable section of the first ladder section is spaced away, by a first distance, from the first foldable section and the second foldable section of the first ladder section, as measured in the depthwise direction of the first ladder section, and the pivot pin of each hinge assembly which connects the second foldable section and the third foldable section of the first ladder section is spaced away, by a second distance, from the second foldable section and the third foldable section of the first ladder section, as measured in the depthwise direction of the first ladder section, the second distance being greater than the first distance.

The pivot pin of each hinge assembly which connects the first foldable section and the second foldable section of the second ladder section is spaced away, by a third distance, from the first foldable section and the second foldable section of the second ladder section, as measured in the depthwise direction of the second ladder section, and the pivot pin of each hinge assembly which connects the second foldable section and the third foldable section of the second ladder section being spaced away, by a fourth distance, from the second foldable section and the third foldable section of the second ladder section, as measured in the depthwise direction of the second ladder section, the fourth distance being less than the third distance.

In one embodiment, the rungs of the first section have a first length and the rungs of the second section have a second length less than the first length such that the second section can slide within the first section.

In another embodiment, the rungs of the first section and second section have substantially equal lengths such that the second section can slide along the first section. In such case, a hook is provided to slidably connect together the end rails of the first and second ladder sections in the lengthwise direction of the ladder, at second, opposite sides of the first and second ladder sections such that the first and second ladder sections are fully slidable along each other. The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
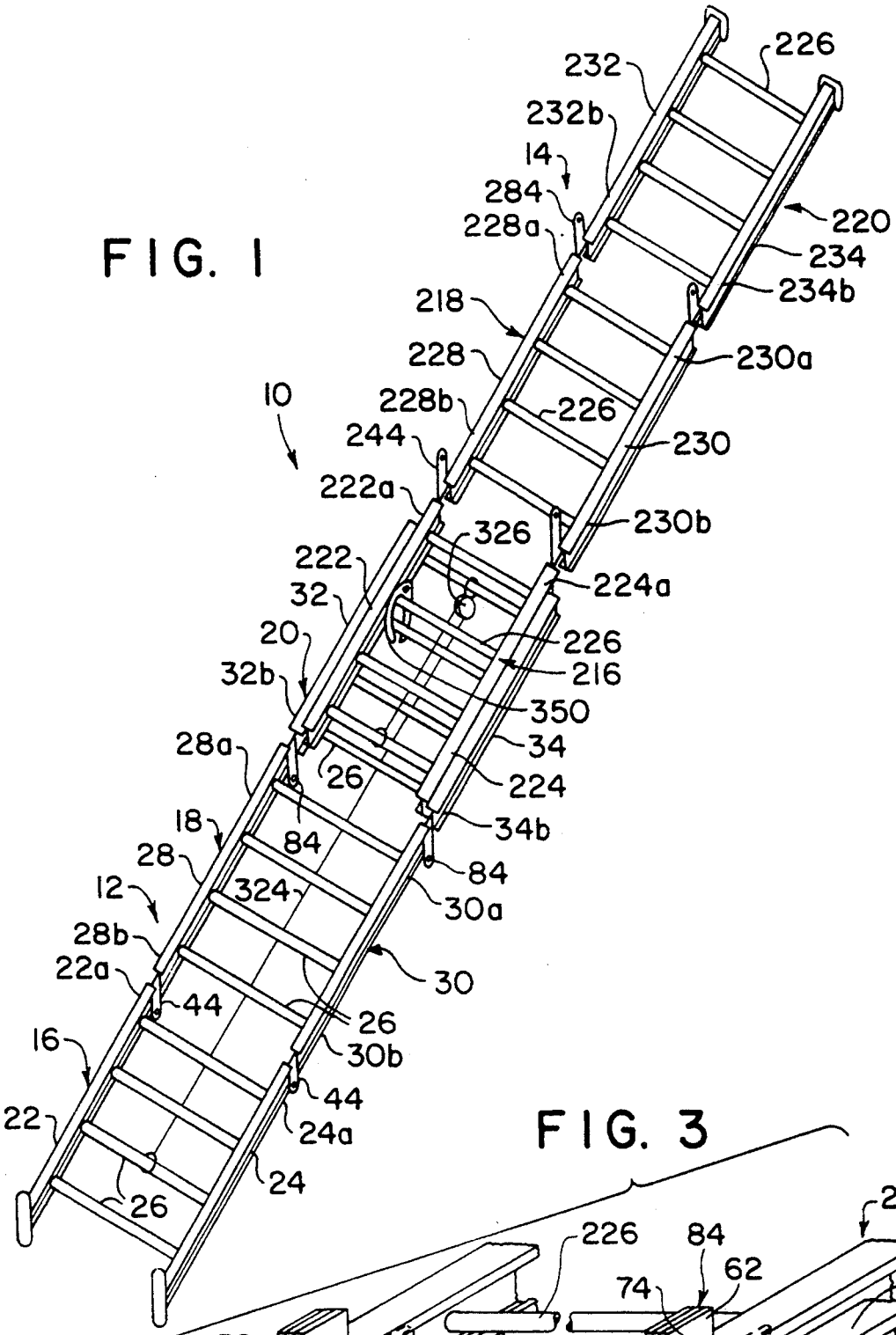
FIG. 1 is a schematic perspective view of a foldable extension ladder according to one embodiment of the present invention, in a fully extended in-line configuration.

Referring to the drawings in detail, and initially to FIGS. 1–6, a foldable extension ladder 10 according to one embodiment of the present invention, includes a lower ladder section 12 and an upper ladder section 14 slidably connected with lower ladder section 12 in the lengthwise direction of ladder 10.

LOWER LADDER SECTION

Lower ladder section 12 includes three foldable sections 16, 18 and 20 hingedly connected in end to end relation with each other. Although three foldable sections 16, 18 and 20 are shown and described herein, the present invention is not limited thereby and lower ladder section 12 may contain two, four or more foldable sections.

Foldable section 16 includes first and second end rails 22 and 24, and a plurality of transverse rungs 26 connecting end rails 22 and 24 together in a parallel, spaced apart relation. In like manner, foldable section 18 includes first and second end rails 28 and 30, and a plurality of transverse rungs 26 connecting end rails 28 and 30 together in a parallel, spaced apart relation; and foldable section 20 includes first and second end rails 32 and 34, and a plurality of transverse rungs 26 connecting end rails 32 and 34 together in a parallel, spaced apart relation. Preferably, rungs 26 are evenly spaced along foldable sections 16, 18 and 20. Although four rungs 26 are shown for each foldable section 16, 18 and 20, the present invention is not limited thereby, and each foldable section 16, 18 and 20 may include two, three, five or more rungs 26.

Each end rail 22, 24; 28, 30; and 32, 34 is formed essentially as an I-beam, that is, with first and second flanges 36 and 38 arranged in a parallel, spaced apart relation and a web 40 connected therebetween such that opposite ends of web 40 extend along central portions of first and second flanges 36 and 38, respectively. In addition, an inturned ledge 42 is formed at the outer ends of first and second flanges 36 and 38, with inturned ledges 42 running the entire length of each end rail 22, 24; 28, 30; and 32, 34.

Transverse rungs 26 are connected between webs 40 of each end rail pair 22, 24; 28, 30; and 32, 34. Specifically, one end of each rung 26 of foldable section 16 is connected to the inner surface of web 40 of one end rail 22, and the opposite end of each rung 26 of foldable section 16 is connected to the inner surface of web 40 of the oppositely facing end rail 24, such that transverse rungs 26 are perpendicular to the lengthwise direction of end rails 22 and 24. In like manner, one end of each rung 26 of foldable section 18 is connected to the inner surface of web 40 of one end rail 28 and the opposite end of each rung 26 of foldable section 18 is connected to the inner surface of web 40 of the oppositely facing end rail 30, such that transverse rungs 26 are perpendicular to the lengthwise direction of end rails 28 and 30. Also, one end of each rung 26 of foldable section 20 is connected to the inner surface of web 40 of one end rail 32 and the opposite end of each rung 26 of foldable section 20 is connected to the inner surface of web 40 of the oppositely facing end rail 34, such that transverse rungs 26 are perpendicular to the lengthwise direction of end rails 32 and 34. Although transverse rungs 26 are shown to have a circular cross-sectional configuration, the present invention is not limited thereby, and transverse rungs 26 can have any other suitable cross-sectional configuration, such as a rectangle, square, triangle or the like.

Figure 3:
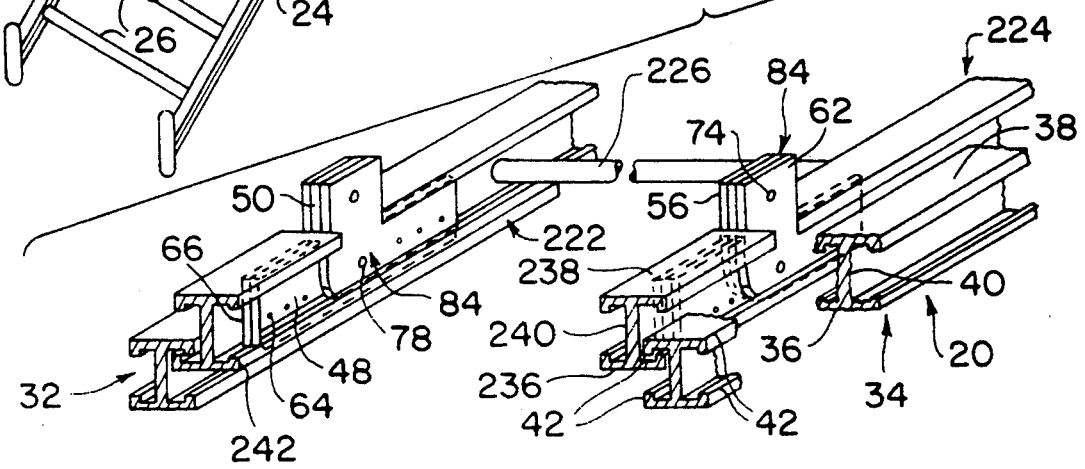
FIG. 3 is a cross-section, viewed in perspective, of a portion of the foldable extension ladder of FIG. 2, taken along line 3—3 thereof, showing the sliding relation therebetween.
Figures 2, 10:
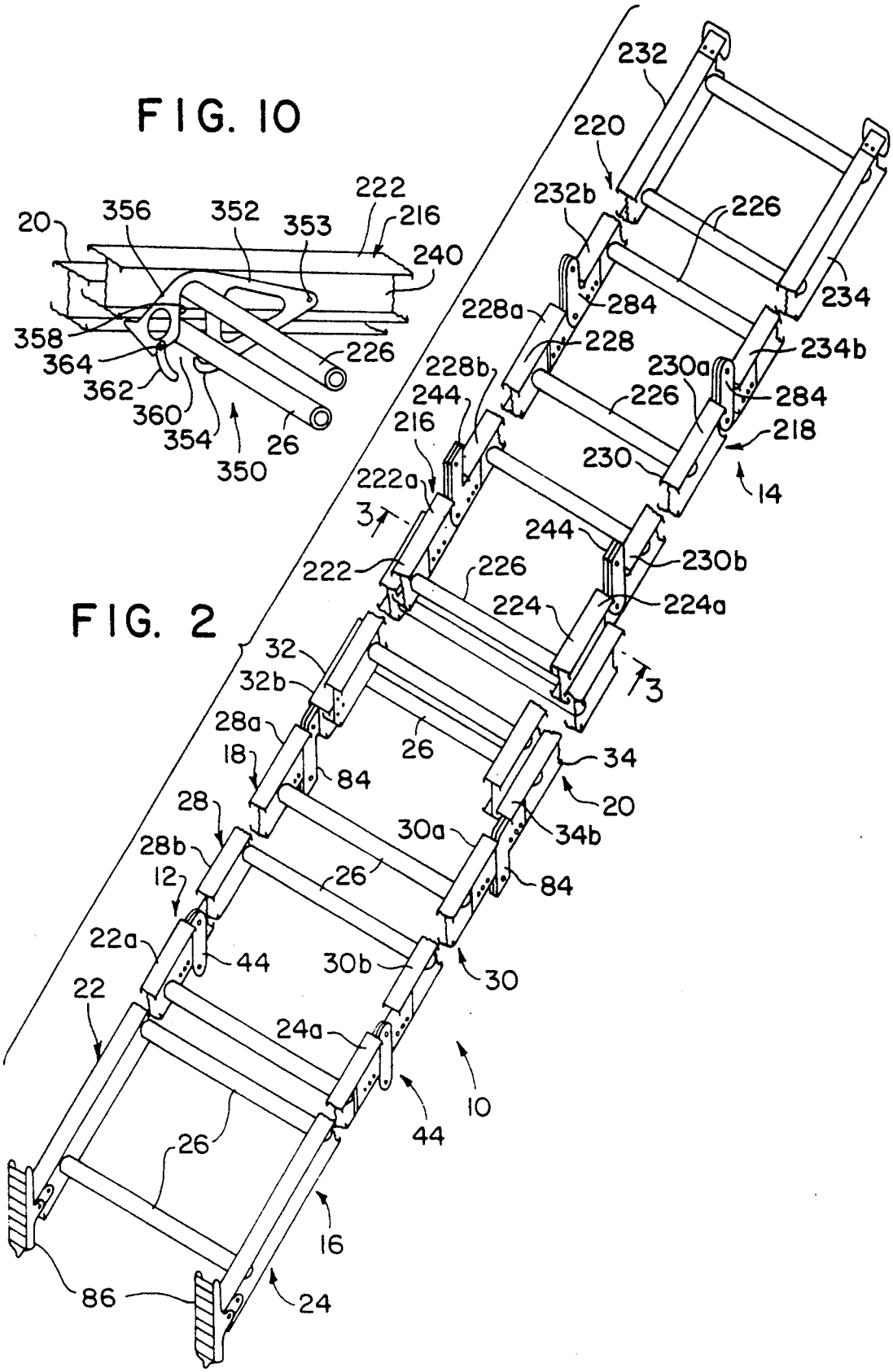
FIG. 2 is a broken away, perspective view of the foldable extension ladder of FIG. 1 in the fully extended in-line configuration.
FIG. 10 is an enlarged perspective view of the ladder of FIG. 1, showing the pivoting hook assembly.
Figure 4:
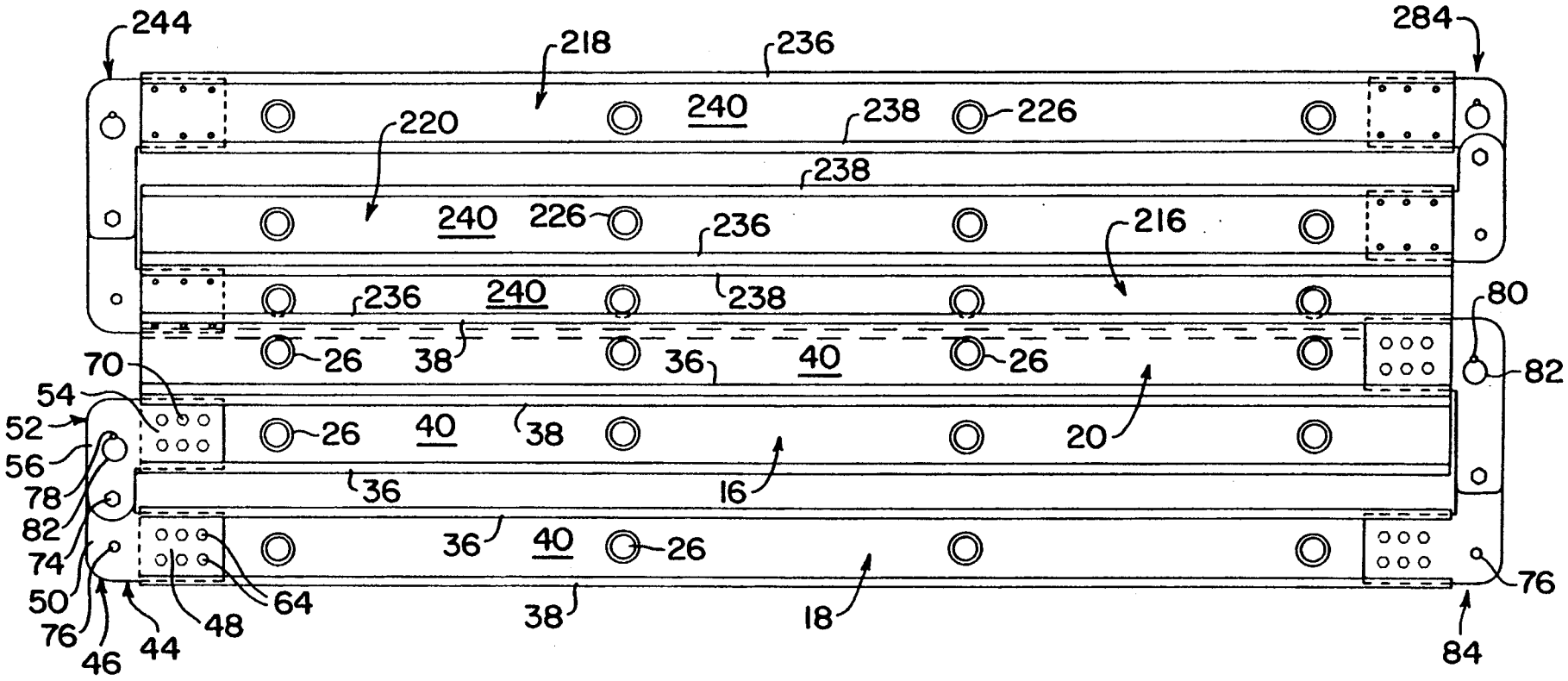
FIG. 4 is a side elevational view of the ladder of FIG. 2, in a fully folded configuration.
Figure 5:
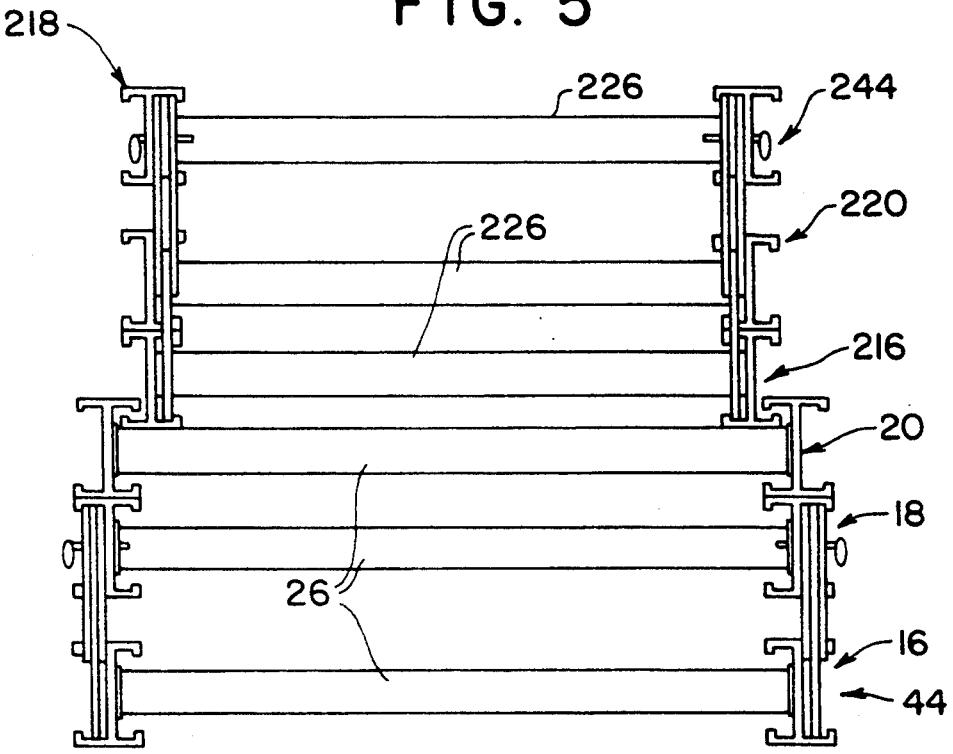
FIG. 5 is a front elevational view of the ladder of FIG. 4.

Foldable sections 16, 18 and 20 are connected in end to end relation for movement between the extended in-line configuration of FIGS. 1–3 in which foldable sections 16, 18 and 20 are arranged substantially in-line with each other in the lengthwise direction of ladder 10, and the folded configuration of FIGS. 4 and 5, in which all foldable sections 16, 18 and 20 are arranged in a substantially parallel, overlaying relation with each other.

The foldable sections are connected to each other such that an upper end 22*a* of first end rail 22 of foldable section 16 is arranged adjacent to the lower end 28*b* of first end rail 28 of foldable section 18, and the opposite upper end 28*a* of first end rail 28 of foldable section 18 is arranged adjacent to the lower end 32*b* of first end rail 32 of foldable section 20. In like manner, upper end 24*a* of second end rail 24 of foldable section 16 is arranged adjacent to the lower end 30*b* of second end rail 30 of foldable section 18, and the opposite upper end 30*a* of second end rail 30 of foldable section 18 is arranged adjacent to the lower end 34*b* of second end rail 34 of foldable section 20.

In order to effect such connections, hinges 44 are connected between the upper ends 22*a* and 24*a* of first and second end rails 22 and 24 of foldable section 16 and the lower ends 28*b* and 30*b* of first and second end rails 28 and 30 of foldable section 18, respectively.

Figure 6:
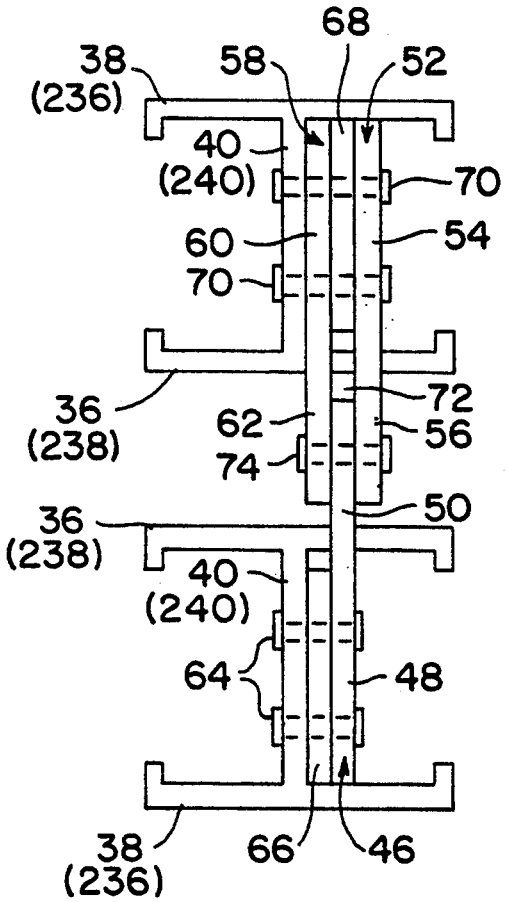
FIG. 6 is an enlarged front plan view of one of the hinges of the ladder of FIG. 5.

As best shown in FIGS. 4–6, each hinge 44 includes a first L-shaped plate 46 with a lengthwise leg 48 and a perpendicularly oriented transverse leg 50; a second L-shaped plate 52 with a lengthwise leg 54 and a perpendicularly oriented transverse leg 56; and a third L-shaped plate 58 with a lengthwise leg 60 and a perpendicularly oriented transverse leg 62. Second L-shaped plate 52 and third L-shaped plate 58 have identical configurations and dimensions. The lengthwise legs 48 of first L-shaped plates 46 are fixedly secured by bolts or rivets 64 against outer surfaces of webs 40 of first and second end rails 22 and 24 of foldable section 16 at the upper ends 22*a* and 24*a* thereof, so as to extend in the lengthwise direction of end rails 22 and 24. In order to obtain the correct spacing for first L-shaped plates 46, a spacer plate 66 is sandwiched between each web 40 and the respective lengthwise leg 48.

In like manner, lengthwise legs 54 and 60 of second and third L-shaped plates 52 and 58 are positioned parallel with each other, and are spaced apart by a spacer plate 68. Each combination of lengthwise leg 54, lengthwise leg 60 and spacer plate 68 is fixedly secured by bolts or rivets 70 against outer surfaces of webs 40 of first and second end rails 28 and 30 of foldable section 18 at the lower ends 28*b* and 30*b* thereof, so that the combination extends in the lengthwise direction of end rails 28 and 30.

When secured in this manner, transverse legs 50 effectively form transverse extensions of first and second end rails 22 and 24 at the upper ends 22*a* and 24*a* thereof; and transverse legs 56 and 62 effectively form transverse extensions of each of the first and second end rails 28 and 30 at the lower ends 28*b* and 30*b* thereof, with transverse legs 56 and 62 being provided in parallel, spaced apart relation with a gap 72 therebetween. The width of gap 72 is set by the thickness of spacer plate 68 and is slightly larger than the thickness of transverse leg 50 so as to permit transverse leg 50 to slide in gap 72 between transverse legs 56 and 62.

The free end of each transverse leg 50 is pivotally connected to the free ends of respective transverse legs 56 and 62 by a pivot pin 74, so as to hingedly connect first and second end rails 22 and 24 of foldable section 16 to first and second end rails 28 and 30 of foldable section 18. Thus, in the in-line configuration of FIGS. 1–3, transverse legs 50 are pivoted to a position between transverse legs 56 and 62, and in the folded configuration of FIGS. 4 and 5, transverse legs 50 are in-line with transverse legs 56 and 62 but positioned out of gaps 72. As shown in FIGS. 1–3, when the ladder is in the in-line configuration, transverse legs 50, 56 and 62 of hinges 44 are in parallel alignment and extend outwardly of first flanges 36 in a depthwise direction perpendicular to the lengthwise direction of the end rails 22, 24 and 28, 30 and the transverse direction of rungs 26.

Each transverse leg 50 has a lock opening 76, and each transverse leg 56 and 62 has a lock opening 78, with the lock openings 78 of respective transverse legs 56 and 62 being in alignment with each other and being in alignment with lock opening 76 when ladder 10 is in the in-line configuration of FIGS. 1–3. Locking pins 80 can be fit through lock opening 76 and lock openings 78 of each hinge 44 when ladder 10 is in the in-line configuration, in order to releasably lock hinges 44 in such position. A ring 82 can be provided on the outer end of each locking pin 80 in order to easily grasp and remove locking pins 80 from the respective lock openings.

Further, hinges 84 are connected between the upper ends 28*a* and 30*a* of first and second end rails 28 and 30 of foldable section 18 and the lower ends 32*b* and 34*b* of first and second end rails 32 and 34 of foldable section 20, respectively. Each hinge 84 is of an identical construction to hinges 44, with the exception that the transverse legs 50, 56 and 62 of hinges 84 are longer than the transverse legs 50, 56 and 62 of hinges 44.

In accordance with an important aspect of the present invention, when ladder 10 is in the in-line configuration of FIGS. 1–3, hinges 44 and 84 are positioned on the same side of ladder 10, that is, on the side of ladder 10 containing first flanges 36 of the end rails. This is very different from a conventional folding ladder in which the hinges are provided alternately on opposite sides of the ladder.

Further, in accordance with a related important aspect of the invention, as discussed above, the transverse legs 50, 56 and 62 of hinges 84 are longer than the transverse legs 50, 56 and 62 of hinges 44. This enables ladder 10 to be fully folded into the configuration of FIGS. 4 and 5 in which all of the foldable sections 16, 18 and 20 are in parallel, overlaying relation, while still permitting the ladder to be unfolded into the in-line configuration of FIGS. 1–3. The folding operation is accomplished by first pivoting foldable section 16 about hinges 44 until foldable section 16 is provided in parallel, overlaying relation to foldable section 18. Then, foldable section 18 is pivoted about hinges 84 until foldable sections 16 and 18 are provided in parallel, overlaying relation to foldable section 20, as shown in FIGS. 4 and 5.

Of course, when the ladder is in the in-line configuration of FIGS. 1–3, because the transverse legs 50, 56 and 62 of hinges 84 are longer than the transverse legs 50, 56 and 62 of hinges 44, the transverse legs 50, 56 and 62 of hinges 84 will extend outwardly in the transverse direction of ladder 10 to a greater extent than the transverse legs 50, 56 and 62 of hinges 44. However, this will not affect the operation of the ladder.

The key to the above limitation is that the axes or pivot points of pivot pins 74 of hinges 44 extend outwardly from lower ladder section 12, as measured in the depthwise direction (perpendicular to the transverse direction of rungs 26 and perpendicular to the lengthwise direction of the end rails) of lower ladder section 12, to a lesser extent than the depthwise extension of the axes or pivot points of pivot pins 74 of hinges 84 from lower ladder section 12. This permits the complete folding of lower ladder section 12 into the folded configuration of FIGS. 4 and 5 in which all foldable sections 16, 18 and 20 are arranged in a substantially parallel, overlaying relation with each other.

As discussed above, it is possible to provide more than three foldable sections 16, 18 and 20. In such case, the hinges connecting the fourth foldable section to the upper end of foldable section 20 would be larger than hinges 84, and so on. In other words, the transverse legs 50, 56 and 62 of the hinges of lower ladder section 12 are in sequentially increasing size, so that pivot pins 74 of the hinges connecting such a fourth section would extend outwardly in the depthwise direction of lower ladder section 12 by a greater amount than pivot pins 74 of hinges 84, and so on with each added foldable section.

Further, in order to provide stability to ladder 10 when used in the extended in-line configuration, stabilizing feet 86 can be pivotally secured to lower ends **22*b* and 24*b* of first and second end rails 22 and 24 of foldable section 16**, as in conventional extension ladders.

UPPER LADDER SECTION

Upper ladder section 14 includes three foldable sections 216, 218 and 220 hingedly connected in end to end relation with each other. Although three foldable sections 216, 218 and 220 are shown and described herein, the present invention is not limited thereby and upper ladder section 14 may contain two, four or more foldable sections.

Foldable section 216 includes first and second end rails 222 and 224, and a plurality of transverse rungs 226 connecting end rails 222 and 224 together in a parallel, spaced apart relation. In like manner, foldable section 218 includes first and second end rails 228 and 230, and a plurality of transverse rungs 226 connecting end rails 228 and 230 together in a parallel, spaced apart relation; and foldable section 220 includes first and second end rails 232 and 234, and a plurality of transverse rungs 226 connecting end rails 232 and 234 together in a parallel, spaced apart relation. Preferably, rungs 226 are evenly spaced along foldable sections 216, 218 and 220. Although four rungs 226 are shown for each foldable section 216, 218 and 220, the present invention is not limited thereby, and each foldable section 216, 218 and 220 may include two, three, five or more rungs 226.

Each end rail 222, 224; 228, 230; and 232, 234 is formed essentially as an I-beam, that is, with first and second flanges 236 and 238 arranged in a parallel, spaced apart relation and a web 240 connected therebetween such that opposite ends of web 240 extend along central portions of first and second flanges 236 and 238, respectively. In addition, an inturned ledge 242 is formed at the outer ends of first and second flanges 236 and 238, with inturned ledges 242 running the entire length of each end rail 222, 224; 228, 230; and 232, 234. Transverse rungs 226 are connected between webs 240 of each end rail pair 222, 224; 228, 230; and 232, 234. Specifically, one end of each rung 226 of foldable section 216 is connected to the inner surface of web 240 of one end rail 222 and the opposite end of each rung 226 of foldable section 216 is connected to the inner surface of web 240 of the oppositely facing end rail 224, such that transverse rungs 226 are substantially perpendicular to the lengthwise direction of end rails 222 and 224. In like manner, one end of each rung 226 of foldable section 218 is connected to the inner surface of web 240 of one end rail 228 and the opposite end of each rung 226 of foldable section 218 is connected to the inner surface of web 240 of the oppositely facing end rail 230, such that transverse rungs 226 are substantially perpendicular to the lengthwise direction of end rails 228 and 230. Also, one end of each rung 226 of foldable section 220 is connected to the inner surface of web 240 of one end rail 232 and the opposite end of each rung 226 of foldable section 220 is connected to the inner surface of web 240 of the oppositely facing end rail 234, such that transverse rungs 226 are substantially perpendicular to the lengthwise direction of end rails 232 and 234. Although transverse rungs 226 are shown to have a circular cross-sectional configuration, the present invention is not limited thereby, and transverse rungs 226 can have any other suitable cross-sectional configuration, such as a rectangle, square, triangle or the like.

Foldable sections 216, 218 and 220 are connected in end to end relation for movement between the extended in-line configuration of FIGS. 1–3 in which foldable sections 216, 218 and 220 are arranged substantially in-line with each other in the lengthwise direction of ladder 10, and the folded configuration of FIGS. 4 and 5 in which all foldable sections 216, 218 and 220 are arranged in a substantially parallel, overlaying relation with each other.

The foldable sections are connected to each other such that an upper end **222*a* of first end rail 222 of foldable section 216 is arranged adjacent to the lower end 228*b* of first end rail 228 of foldable section 218, and the opposite upper end 228*a* of first end rail 228 of foldable section 218 is arranged adjacent to the lower end 232*b* of first end rail 232 of foldable section 220. In like manner, the upper end 224*a* of second end rail 224 of foldable section 216 is arranged adjacent to the lower end 230*b* of second end rail 230 of foldable section 218, and the opposite upper end 230*a* of second end rail 230 of foldable section 218 is arranged adjacent to the lower end 234*b* of second end rail 234 of foldable section 220**.

In order to effect such connections, hinges 244 are connected between the upper ends **222*a* and 224*a* of first and second end rails 222 and 224 of foldable section 216 and the lower ends 228*b* and 230*b* of first and second end rails 228 and 230 of foldable section 218, respectively. Each hinge 244 is of an identical construction to hinges 84**, as discussed above.

As shown in FIGS. 1–3, when ladder 10 is in the in-line configuration, transverse legs 50, 56 and 62 of hinges 244 are in parallel alignment and extend outwardly of second flanges 238 in a depthwise direction perpendicular to the lengthwise direction of the end rails 222, 224 and 228, 230 and the transverse direction of rungs 226.

Further, hinges 284 are connected between the upper ends **228*a* and 230*a* of first and second end rails 228 and 230 of foldable section 218 and the lower ends 232*b* and 234*b* of first and second end rails 232 and 234 of foldable section 220, respectively. Each hinge 284 is of an identical construction to hinges 44**, as discussed above.

As shown in FIGS. 1–3, when ladder 10 is in the in-line configuration, transverse legs 50, 56 and 62 of hinges 284 are in parallel alignment and extend outwardly of second flanges 238 in a depthwise direction perpendicular to the lengthwise direction of the end rails 228, 230 and 232, 234 and the transverse direction of rungs 226.

As will be appreciated from the above, an important aspect of the present invention is that, when ladder 10 is in the in-line configuration of FIGS. 1–3, hinges 244 and 284 are positioned on the same side of the ladder, that is, on the side of the ladder containing second flanges 238 of the end rails. This is very different from a conventional folding ladder in which the hinges are provided alternately on opposite sides of the ladder.

Further, in accordance with a related important aspect of the invention, the transverse legs 50, 56 and 62 of hinges 244 are longer than the transverse legs 50, 56 and 62 of hinges 284. This enables the ladder to be fully folded into the configuration of FIGS. 4 and 5 in which all of the foldable sections 216, 218 and 220 are in a parallel, overlaying relation, while still permitting the ladder to be unfolded into the in-line configuration of FIGS. 1–3. The folding operation is accomplished by first pivoting foldable section 220 about hinges 284 until foldable section 220 is provided in parallel, overlaying to foldable section 218. Then, foldable section 218 is pivoted about hinges 244 until foldable sections 218 and 220 are provided in parallel, overlaying relation to foldable section 216, as shown in FIGS. 4 and 5.

Of course, when the ladder is in the in-line configuration, because transverse legs 50, 56 and 62 of hinges 244 are longer than transverse legs 50, 56 and 62 of hinges 284, transverse legs 50, 56 and 62 of hinges 244 will extend outwardly in the transverse direction of the ladder to a greater extent than the transverse legs 50, 56 and 62 of hinges 284. However, this will not affect the operation of the ladder.

The key to the above limitation is that the axes or pivot points of pivot pins 74 of hinges 284 extend outwardly from upper ladder section 14, as measured in the depthwise direction (perpendicular to the transverse direction of rungs 226 and perpendicular to the lengthwise direction of the end rails) of upper ladder section 14, to a lesser extent than the depthwise extension of the axes or pivot points of pivot pins 74 of hinges 244 from upper ladder section 14. This permits the complete folding of upper ladder section 14 into the folded configuration of FIGS. 4 and 5 in which all foldable sections 216, 218 and 220 are arranged in a substantially parallel, overlaying relation with each other.

As discussed above, it is possible to provide more than three foldable sections 216, 218 and 220. In such case, hinges connecting the fourth foldable section to the lower end of foldable section 216 would be larger than hinges 244, and so on. In other words, the hinges of upper ladder section 14 would be provided in sequentially increasing size so that pivot pins 74 of the hinges connecting the fourth section would extend outwardly in the depthwise direction of upper ladder section 14 by a greater amount than pivot pins 74 of hinges 244, and so on with each added foldable section.

FIRST EMBODIMENT OF SLIDING RELATION

In a first embodiment, in order to slidably connect lower and upper ladder sections 12 and 14 together, rungs 26 of lower ladder section 12 are made longer in the transverse direction of ladder 10 than rungs 226 of upper ladder section 14. Accordingly, the transverse distance between end rails 222, 224; 228, 230; and 232, 234 of upper ladder section 14 is less than the transverse distance between end rails 22, 24; 28, 30; and 32, 34 of lower ladder section 12.

With this arrangement, first flanges 236 of upper ladder section 14 can slide between webs 40 of lower ladder section 12, adjacent to second flanges 38 of lower ladder section 12, as shown best in FIG. 3. In order to better retain lower and upper ladder sections 12 and 14 in such sliding relation, inturned ledges 242 on first flanges 236 of upper ladder section 14 can engage or hook with inturned ledges 42 on second flanges 38 of lower ladder section 12.

As will be appreciated from the above, transverse legs 50, 56 and 62 of hinges 44 and 84 extend to the same side of ladder 10, that is, to the side adjacent first flanges 36; and transverse legs 50, 56 and 62 of hinges 244 and hinges 284 extend to the same side of ladder 10, that is, to the side adjacent second flanges 238. Because of this relationship and because transverse legs 50, 56, 62 of lower ladder section 12 extend to the opposite side of ladder 10 from transverse legs 50, 56 and 62 of upper ladder section 14, none of these transverse legs interferes with the sliding movement of upper ladder section 14 within lower ladder section 12.

As a further safeguard against sliding interference, and as discussed above, hinges 44 and 84 are secured to the outer faces of webs 40 of lower ladder section 12, while hinges 244 and 284 are secured to the inner faces of webs 240 of upper ladder section 14. However, this need not be the case. For example, it is possible to provide hinges 44 and 84 on the inner faces of webs 40 of lower ladder section 12, and hinges 244 and 284 on the outer faces of webs 240 of upper ladder section 14, provided that the lengths of rungs 226 are decreased even further or the lengths of rungs 26 are increased even further to incorporate such changes in the positioning of the hinges. However, in either case, it is important that hinges 44 and 84 of lower ladder section 12 extend from one side of ladder 10, while hinges 244 and 284 of upper ladder section 14 extend from the opposite side of ladder 10.

It will be appreciated that, in order to arrange ladder 10 in the folded configuration of FIGS. 4 and 5, only foldable section 20 of lower ladder section 12 and foldable section 216 of upper ladder section 14 can be in sliding relation with each other. Otherwise, if any of the other foldable sections are in such sliding relation, it would not be possible to fold that other foldable section. For example, if foldable sections 18 and 20 of lower ladder section 12 are in sliding relation with foldable sections 216 and 218, respectively, of upper ladder section 14, foldable section 18 could not fold with respect to foldable section 20, and foldable section 216 could not fold with respect to foldable section 218. This is made clear by the folded configuration of FIGS. 4 and 5.

As shown in FIG. 1, in order to more easily effect such sliding relation, and as is well known from conventional extension ladders, one end of a rope 324 is connected to a lower rung 26 of lower ladder section 12. Rope 324 is engaged about a pulley 326 mounted to an upper rung 26 of lower ladder section 12, and the opposite end of rope 324 is connected to a lower rung 226 of upper ladder section 14. Accordingly, when ladder 10 is in the in-line configuration and the end of rope 324 adjacent to the lower rung 26 of lower ladder section 12 is pulled down, upper ladder section 14 is caused to slide upwardly with respect to lower ladder section 12 so as to raise or extend ladder 10.

SECOND EMBODIMENT OF SLIDING RELATION

Figure 7:
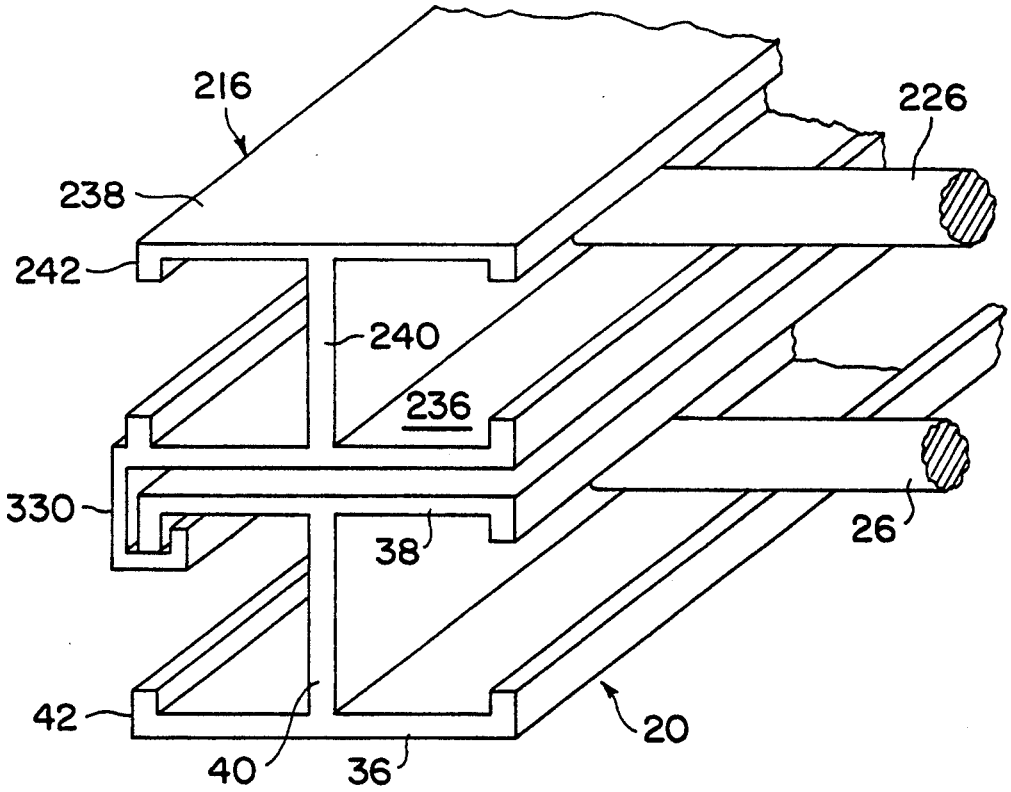
FIG. 7 is an enlarged perspective view showing a modification of the sliding relation of the first and second ladder sections.

In a second embodiment, as shown in FIG. 7, rungs 26 of lower ladder section 12 are equal in length in the transverse direction of ladder 10 to rungs 226 of upper ladder section 14. Accordingly, the transverse distance between end rails 222, 224; 228, 230; and 232, 234 of upper ladder section 14 is equal to the transverse distance between end rails 22, 24; 28, 30; and 32, 34 of lower ladder section 12.

With this arrangement, second flanges 38 of lower ladder section 12 can slide against first flanges 236 of upper ladder section 14. In order to retain lower and upper ladder sections 12 and 14 in such sliding relation, an elongated hook 330 is provided as an extension on first flanges 236 of foldable sections 216 and 218 of upper ladder section 14 for slidably capturing the outer inturned ledge 42 of the second flanges 38 of foldable sections 16, 18 and 20 of lower ladder section 12. It will be appreciated that elongated hook 330 is not formed on first flange 236 of the uppermost foldable section 220, since this would interfere with the folding of ladder 10 into the folded configuration of FIGS. 4 and 5.

As with the aforementioned embodiment, transverse legs 50, 56 and 62 of hinges 44 and hinges 84 extend to the same side of ladder 10, that is, to the side adjacent first flanges 36, and transverse legs 50, 56 and 62 of hinges 244 and hinges 284 extend to the same side of ladder 10, that is, to the side adjacent second flanges 238. Because of this relationship and because transverse legs 50, 56 and 62 of lower ladder section 12 extend to the opposite side of ladder 10 from transverse legs 50, 56 and 62, none of these transverse legs interferes with the sliding movement of upper ladder section 14 within lower ladder section 12.

As with the aforementioned first embodiment of the sliding relation, it will be appreciated that, in order to arrange ladder 10 in the folded configuration of FIGS. 4 and 5, only foldable section 20 of lower ladder section 12 and foldable section 216 of upper ladder section 14 can be in sliding relation with each other.

Alternatively, in place of elongated hook 330, one or more separate hooks or C-shaped retainers can be used to engage adjacent ledges 42 and 242.

MODIFIED END RAIL CONFIGURATIONS

Figure 9:
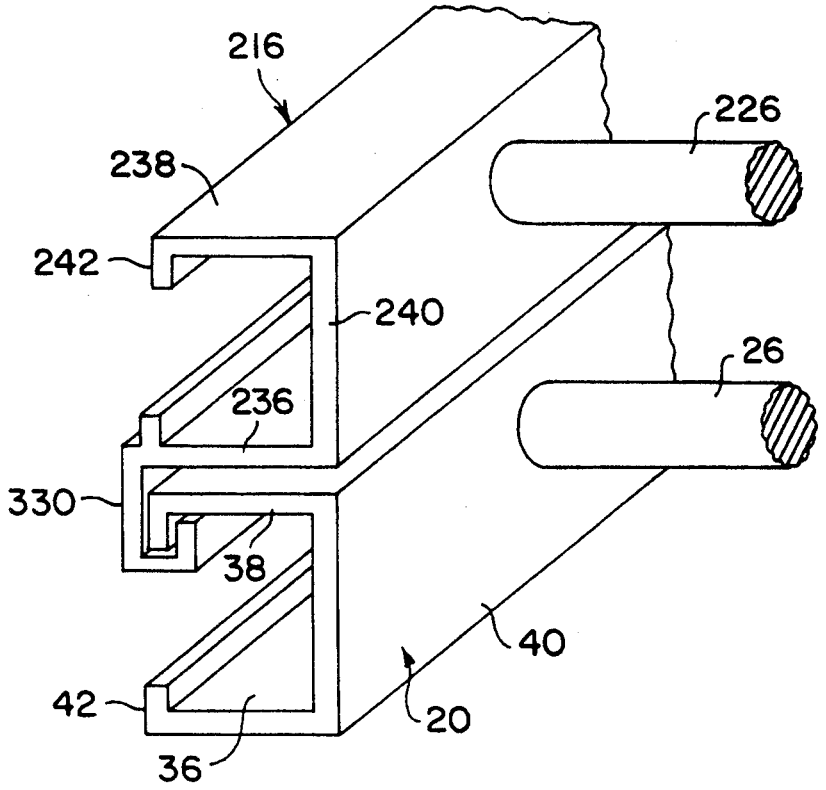
FIG. 9 is an enlarged perspective view showing a ladder according to still another embodiment of the present invention, in which the end rails have C-shaped cross-sectional configurations.
Figure 8:
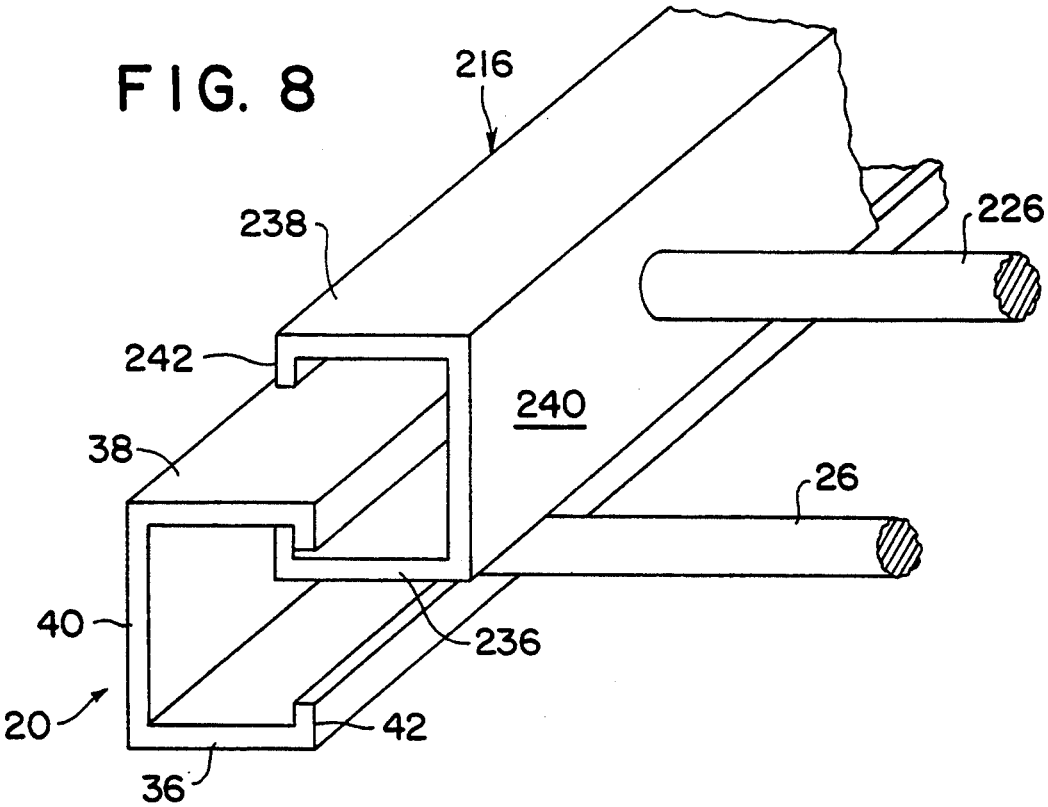
FIG. 8 is an enlarged perspective view showing a ladder according to another embodiment of the present invention, in which the end rails have C-shaped cross-sectional configurations.

As a modification to the first embodiment of the sliding relation, rather than forming each end rail as an I-beam, the end rails can be formed having a C-shaped cross-sectional configuration, as shown, for example, in FIG. 8. A similar modification to an end rail having a C-shaped cross-sectional configuration can be used in the second embodiment of the sliding relation, as shown in FIG. 9.

Alternatively, although not shown, other cross-sectional configurations for the end rails can be used. For example, a square or rectangular cross-sectional configuration can be used. Still further, it is possible in such case to have upper ladder section 14 slide within lower ladder section 12, in a manner similar to that taught by U.S. Pat. No. 3,692,143 to Kummerlin et al.

RELEASABLE LOCKING OF SLIDING LADDERS

As discussed above, because hinges 44 and 84 of lower ladder section 12 are on opposite sides of ladder 10 from hinges 244 and 284 on upper ladder section 14, lower and upper ladder sections 12 and 14 are fully slidably with respect to each other.

In order to releasably lock lower ladder section 12 and upper ladder section 14 with respect to each other at a desired slidable position, when ladder 10 is in the in-line configuration of FIGS. 1–3, a conventional pivoting hook assembly 350 can be used. Specifically, as shown in FIG. 1, pivoting hook assembly 350 includes a substantially triangular main body 352 having one corner pivotally secured by a pivot pin 353 to the inner surface of web 240 of first end rail 222 of foldable section 216.

Pivoting hook assembly 350 further includes a short, slightly inwardly curved extension 354 at another corner of triangular main body 352, and a larger curved extension 356 at the last remaining corner. An elongated slot 358 is formed in the larger extension 356, and an opening 360 for the elongated slot 358 is defined between the free ends of extensions 354 and 356. Further, a pivoted closure lever 362 is pivotally connected by a pivot pin 364 to the free end of larger extension 356, adjacent to opening 360. A spring (not shown), such as a torsion spring, is mounted about pivot pin 353 and normally biases pivoting hook assembly 350 in the counterclockwise direction of FIG. 10.

One rung 226 of upper ladder section 14 is housed at the closed end of elongated slot 358. For example, the third highest rung 226 of first end rail 222 of foldable section 216 can be housed within elongated slot 358.

During extension of ladder 10 in the in-line configuration, upper ladder section 14 is slid along lower ladder section 12. At such time, the outer surface of short extension 354 impacts against rungs 26 of lower ladder section 12 and thereby biases pivoting hook assembly 350 in the clockwise direction of FIG. 10, against the force of the torsion spring. This causes the rung 226 held in elongated slot 358 to move away from the closed end thereof, while still remaining in elongated slot 358. This operation continues as each rung 26 passes by pivoting hook assembly 350. Further, it will be appreciated that pivoted closure lever 362 hangs down in the open position shown in FIG. 10 at this time, and the inner surface thereof impacts against each rung 26 immediately following the impact of short extension 354 against each rung 26, thereby causing the same pivoting action. Therefore, pivoting hook assembly 350 is pivoted twice in the clockwise direction against each rung 26, once by short extension 354 and the second time by pivoted closure lever 362.

When ladder 10 is at the desired height, upper ladder section 14 is slid upwardly with respect to lower ladder section 12 such that pivoting hook assembly 350 is moved upwardly slightly past the respective rung 26 desired to be caught by pivoting hook assembly 350, so that the respective rung 26 is at a position between the lower end of short extension 354 and pivoted closure lever 362. In other words, there is only a first pivoting action of pivoting hook assembly 350 against the respective rung 26 by means of short extension 354, but there is no second pivoting action caused by pivoted closure lever 362. Then, upper ladder section 14 is lowered slightly. During the lowering movement, the torsion spring has already biased pivoting hook assembly 350 in the counterclockwise direction of FIG. 10, back to its original position. Accordingly, the respective rung 26 is caught by the free end of short extension 354 and forced into elongated slot 358, as shown in FIG. 10. As a result, upper ladder section 14 cannot slide down with respect to lower ladder section 12, and ladder 10 is held in a desired extended position.

In order to release ladder sections 12 and 14 with respect to each other, and once again provide the sliding movement, upper ladder section 14 is slid upwardly with respect to lower ladder section 12. At this time, the respective rung 26 caught in elongated slot 358 moves out of elongated slot 358. Upward movement is continued until the respective rung 26 impacts against and passes pivoted closure lever 362. Then, upper ladder section 14 is lowered with respect to lower ladder section 12.

During this lowering movement, each rung 26 impacts against the outer surface of pivoted closure lever 362, which causes pivoted closure lever 362 to pivot in the counterclockwise direction of FIG. 10, until it abuts against the outer surface of short extension 354, thereby closing opening 360. As a result, the rung 26 which has hit against pivoted closure lever 362 rides against the outer surface thereof, and does not enter elongated slot 358. This continues for each rung 26 that impacts against pivoted closure lever 362. When a new desired height is achieved by such sliding movement, a new respective rung 26 is captured in elongated slot 358 in the manner discussed above.

In order to provide better holding and better stability for ladder 10, it is preferred that a pivoting hook assembly 350 is also pivotally secured to the inner surface of web 240 of second end rail 224 of foldable section 216, directly opposite to pivoting hook assembly 350 on first end rail 222 of foldable section 216.

SPRING-LOADED PIN

As discussed above, a locking pin 80 can be fit through lock openings 76 and 78 of the hinges when the ladder is in the in-line configuration, in order to releasably lock the hinges in such position. However, this means that locking pins 80 can become lost when fully disengaged from the respective hinges. Also, because the locking pins must be fully removed, use of the same can be burdensome.

Figure 11:
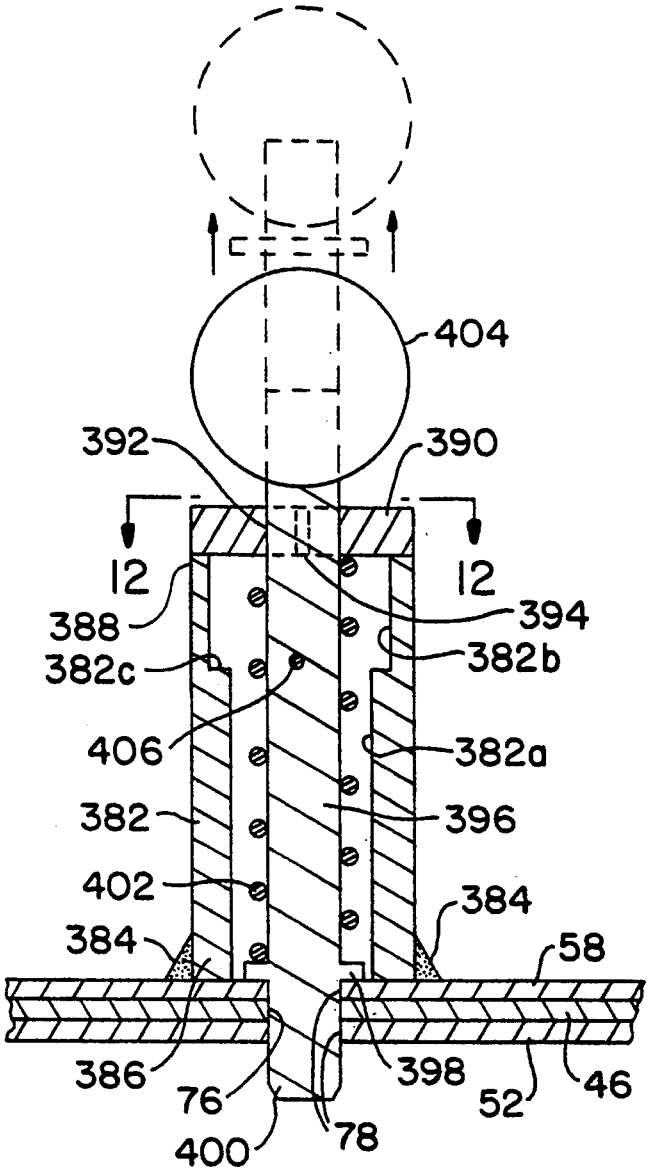
FIG. 11 is longitudinal cross-sectional view of a spring-loaded locking pin for use with the present invention.
Figure 12:
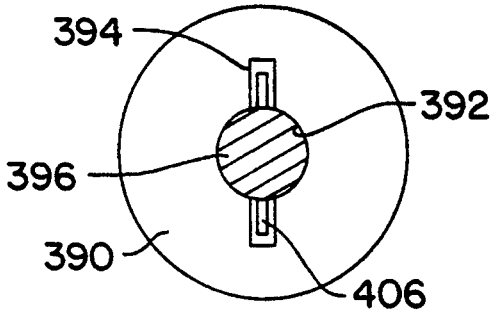
FIG. 12 is a cross-sectional view of the spring-loaded locking pin of FIG. 11, taken along line 12—12 thereof.

In this regard, the present invention envisions the use of spring loaded locking pins. One embodiment of such a spring loaded locking pin 380 is shown in FIGS. 11 and 12, which is a commercially available spring loaded pin arrangement. Such a pin arrangement is similar in many respects to the spring loaded locking pin of U.S. Pat. No. 2,024,039.

As shown in FIG. 11, a hollow, cylindrical housing 382 is secured by welds 384 to the outer surface of a third or outermost L-shaped plate 58 in surrounding relation to and in axial alignment with the respective lock openings 76 and 78. The inner or lower end 386 of cylindrical housing 382 is open, while the outer or upper end 388 of cylindrical housing 382 is closed by a closure wall 390. Further, the interior of cylindrical housing 382 is provided with an inner or lower chamber **382*a* of a first diameter and an outer or upper chamber 382*b* of a second, larger diameter, thereby defining an annular shoulder 382*c*** therebetween.

Closure wall 390 includes a central circular opening 392, and an elongated slit-like opening 394 crossing central circular opening 392 and extending outwardly therefrom in the radial direction.

A cylindrical locking pin 396 is slidably retained within housing 382 and includes an annular flange 398 spaced slightly upwardly from the lower end of locking pin 396, thereby defining a locking portion 400 of locking pin 396 below annular flange 398. The outer diameter of annular flange 398 is greater than the outer diameter of lock openings 76 and 78.

A coil spring 402 is positioned in surrounding relation to locking pin 396 between closure wall 390 and annular flange 398, to thereby normally bias locking pin 396 into housing 382, and to thereby bias locking portion 400 into locking engagement with the respective lock openings 76 and 78. An enlarged head 404, which is larger than central circular opening 392, is secured to the upper end of locking pin 396.

In order to releasably lock pin 396 in a respective lock opening, a catch pin 406 extends transversely through locking pin 396, at a position immediately below enlarged head 404. Catch pin 406 has a length slightly less than the length of slit-like opening 394, but greater than the diameter of circular opening 392. Accordingly, when catch pin 406 is aligned with slit-like opening 394, coil spring 402 biases locking portion 400 into engagement with the lock openings 76 and 78. In such case, catch pin 406 slides through slit-like opening 394, as shown in FIG. 12, into upper chamber **382*b* of housing 382. Catch pin 406 has a length greater than the diameter of lower chamber 382*a* but less than the diameter of upper chamber 382*b*, and accordingly, catch pin 406 is limited in its inward movement by annular shoulder 382*c*, thereby further limiting inward movement of locking pin 396**.

In order to lock pin 396 in a raised position out of engagement with the lock openings 76 and 78, enlarged head 404 is grasped and pulled outwardly until catch pin 406 exits slit-like opening 394. Then, enlarged head 404 is rotated, thereby rotating locking pin 396 and catch pin 406, as shown by the dashed lines in FIG. 11. When enlarged head 404 is released, coil spring 402 biases locking pin 396 inwardly. Because the length of catch pin 406 is greater than the diameter of circular opening 392 and because catch pin 406 is out of alignment with slit-like opening 394, catch pin 406 rests on the upper surface of closure wall 390. In such case, locking portion 400 is out of engagement with the respective lock openings 76 and 78, thereby permitting pivoting movement of foldable sections 16, 18, 20; and 216, 218, 220 relative to each other.

Although spring loaded locking pin 380 has been shown as one embodiment of a spring loaded pin that can be used, the present invention is not limited thereby, and other spring loaded locking pins can be adapted for use herewith, for example, the spring loaded pins shown in U.S. Pat. Nos. 3,811,151; 4,216,844 and 4,407,045.

HINGE MODIFICATION

It will be appreciated that hinges 44, 84, 244 and 284 can be formed with plates having configurations other than L-shaped configurations. The important point is that the axes or pivot points of pivot pins 74 of hinges 44 and 284 extend outwardly, as measured in the depthwise direction, to a lesser extent than the depthwise extension of the axes or pivot points of pivot pins 74 of hinges 84 and 244, respectively. This permits the complete folding of lower ladder section 12 and upper ladder section 14 into the folded configuration of FIGS. 4 and 5 in which all foldable sections are arranged in a substantially parallel, overlaying relation with each other.

Figure 13:
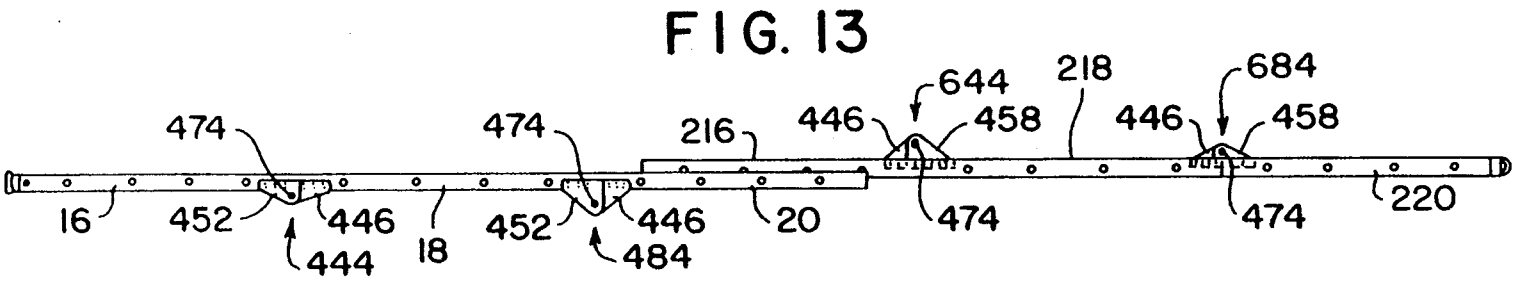
FIG. 13 is an end elevational view of a ladder according to another embodiment of the present invention, in the fully extended, in-line configuration.
Figure 14:
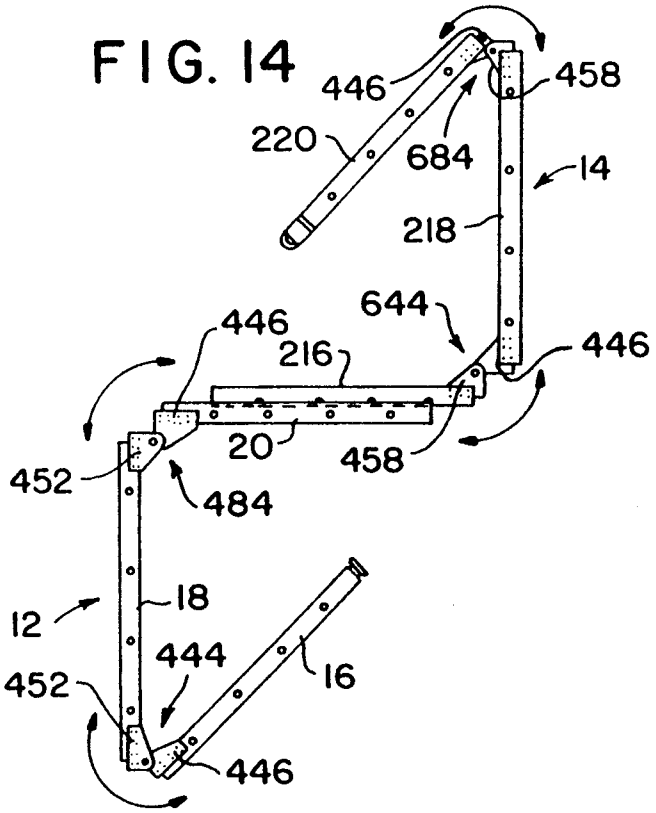
FIG. 14 is an end elevational view of the ladder of FIG. 13, in a partially folded configuration.
Figure 15:
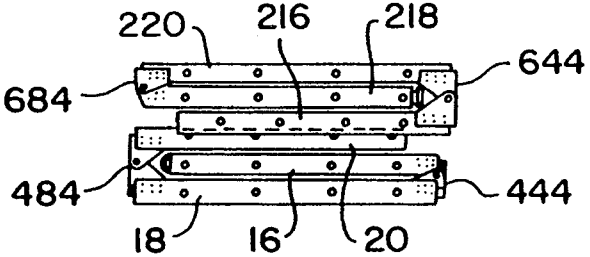
FIG. 15 is an end elevational view of the ladder of FIG. 13, in a fully folded configuration.

One example of a hinge modification is shown in FIGS. 13–15. As shown therein, each hinge 444, 484, 644 and 684 forms a substantially triangular configuration in the in-line configuration of the ladder. Thus, in place of L-shaped plates 46, 52 and 58, each hinge 444, 484, 644, 684 includes corresponding trapezoidal shaped plates 446, 452 and 458. In such case, hinges 444, 484, 644, 684 are best used on end rails without full flanges, such as the end rails of FIG. 9 or an end rail having a square cross-sectional configuration.

As with hinges 44, 84, 244 and 284, it is important that the axes or pivot points of pivot pins 474 of hinges 444 and 684 extend outwardly from the ladder, as measured in the depthwise direction, to a lesser extent than the depthwise extension of the axes or pivot points of pivot pins 474 of hinges 484 and 644 from the ladder. This permits the complete folding of each ladder section 12 and 14 into the folded configuration of FIG. 15 in which all foldable sections 16, 18, 20, 216, 218 and 220 are arranged in a substantially parallel, overlaying relation with each other.

FURTHER MODIFICATIONS

It will be appreciated that various modifications can be made to the present invention, within the scope of the claims herein.

For example, while only two ladder sections 12 and 14 have been shown slidably connected to each other, the present invention is not limited thereby, and more than two such ladder sections can be slidably connected to each other. For example, an additional ladder section comprised of foldable sections can be slidably connected with the upper end of ladder section 12.

Alternatively, a non-folding ladder section can be slidably connected at the free ends of either ladder section 16 or 220, and releasably secured thereto by a pin similar to pin 80 which extends through respective openings.

Still further, other hinges, which are conventional, can be used to provide different angular relationships between adjacent connected folding sections, that is, to provide angular relationships between the fully folded configuration and the in-line configuration. In this manner, the ladder or a ladder section can be folded into an inverted V-configuration, a Δ-configuration or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A foldable extension ladder comprising:

a first ladder section;

a second ladder section;

each of said first and second ladder sections including:

at least three foldable sections, each foldable section including a pair of end rails and a plurality of rungs extending in a transverse direction of said ladder section and connecting said pair of end rails in a parallel, spaced apart relation, and all said foldable sections being of substantially equal length;

a plurality of hinge means for hingedly connecting together said foldable sections in end to end relation for movement between an in-line configuration in which the foldable sections are arranged substantially in-line with each other along a lengthwise direction of said ladder section and a folded configuration in which all of said foldable sections are arranged in a substantially parallel, overlaying relation with each other, each said hinge means including pivot means for pivotally connecting ends of two adjacent ones of said foldable sections, said pivot means of all said hinge means being arranged to a first side of each ladder section, as measured in a depthwise direction which is substantially perpendicular to said transverse and lengthwise directions, when said ladder section is in said in-line configuration; and locking means for releasably locking each said hinge means in a fixed position when two foldable sections at opposite ends of each said hinge means are arranged in said in-line configuration; and means for slidably connecting said end rails of said first and second ladder sections together in said lengthwise direction of said ladder, at second, opposite sides of said first and second ladder sections such that said first and second ladder sections are fully slidable with respect to each other and such that said hinge means of the first and second ladder sections can move past each other in said lengthwise direction during said sliding movement.

2. A foldable extension ladder according to claim 24, wherein successive ones of said pivot means extending in the lengthwise direction of said ladder section, are spaced with an increasing distance away from said ladder section, as measured in said depthwise direction.

3. A foldable extension ladder according to claim 2, wherein each said hinge means includes:

a first hinge plate having:

connecting means for connecting said first hinge plate to one end rail of one foldable section, and a pivot connecting portion extending outwardly of said ladder section, as measured in said depthwise direction;

a second hinge plate having:

connecting means for connecting said second hinge plate to one end rail of another adjacent foldable section, and a pivot connecting portion extending outwardly of said ladder section, as measured in said depthwise direction;

one said pivot pin means pivotally connects said pivot connecting portions of said first and second hinge plates together.

4. A foldable extension ladder according to claim 3, wherein:

said hinge means further includes:

a third hinge plate having connecting means for connecting said third hinge plate to said one end rail of said adjacent foldable section, and a pivot connecting portion extending outwardly of said ladder section, as measured in said depthwise direction, said third hinge plate being in parallel, spaced apart relation to said second hinge plate so as to define a gap therebetween through which said first hinge plate can slide; and said one pivot means pivotally connects said pivot connecting portions of said first, second and third hinge plates together.

5. A foldable extension ladder according to claim 4, wherein each said hinge plate is formed with a lengthwise leg connected in said lengthwise direction to one end rail of a respective foldable section and a connecting leg having a component extending substantially perpendicular to said lengthwise direction, each said connecting leg containing a free end which forms said pivot connection portion of the respective hinge plate.

6. A foldable extension ladder according to claim 3, wherein said first hinge plate includes a first lock opening and said second hinge plate includes a second lock opening in alignment with said first lock opening when said ladder section is in said in-line configuration; and said locking means includes pin means for releasably engaging in said first and second lock openings when said ladder section is in said in-line configuration to releasably lock said ladder section in said in-line configuration.

7. A foldable extension ladder according to claim 6, wherein said locking means further includes spring biasing means for biasing said pin means into engagement with said first and second lock openings, and holding means for releasably holding said pin means out of engagement with said first and second openings against the force of said spring means.

8. A foldable extension ladder according to claim 24, wherein each ladder section includes only three foldable sections.

9. A foldable extension ladder comprising:

a first ladder section;

a second ladder section;

each of said first and second ladder sections including:

a plurality of foldable sections, each said foldable section including a pair of end rails and a plurality of rungs extending in a transverse direction of the respective ladder section and connecting said pair of end rails in a parallel, spaced apart relation, an all said foldable sections being of substantially equal length;

at least one hinge means for hingedly connecting together said plurality of foldable sections in end to end relation for movement between an in-line configuration in which the foldable sections are arranged substantially in-line with each other in a lengthwise direction of said ladder and a folded configuration in which all of said foldable sections are arranged in a substantially parallel, overlaying relation with each other, each said hinge means including pivot means for pivotally connecting ends of two adjacent ones of said foldable sections;

said pivot means of all said hinge means of said first ladder section being arranged to a first side of said first ladder section, as measured in a depthwise direction of said first ladder section, which is substantially perpendicular to said transverse and lengthwise directions thereof, when said first ladder section is in said in-line configuration;

said pivot means of all said hinge means of said second ladder section being arranged to a first side of said second ladder section, as measured in a depthwise direction of said second ladder section, which is substantially perpendicular to said transverse and lengthwise directions thereof, when said second ladder section is in said in-line configuration; and releasable locking means for releasably locking each said hinge means in a fixed position when two foldable sections at opposite ends of each said hinge means are arranged in said in-line configuration; and means for slidably connecting said end rails of said first and second ladder sections together in said lengthwise direction of said ladder, at second, opposite sides of said first and second ladder sections such that said first and second ladder sections are fully slidable with respect to each other and such that said hinge means of the first and second ladder sections can move past each other in said lengthwise direction during said sliding movement.

10. A foldable extension ladder according to claim 9, wherein:

at least one of said first and second ladder sections includes at least three foldable sections, and successive ones of said pivot means in the lengthwise direction of each said ladder section which has at least three foldable sections, are spaced with an increasing distance away from the respective ladder section, as measured in the depthwise direction thereof, when the respective ladder section is in said in-line configuration.

11. A foldable extension ladder according to claim 9, wherein:

said first ladder section includes a first foldable section, a second foldable section and a third foldable section, hingedly connected together in order;

said third foldable section of said first ladder section always being slidably connected with said second ladder section;

said pivot means of each said hinge means which connects said first foldable section and said second foldable section of said first ladder section being spaced away, by a first distance, from said first foldable section and said second foldable section of said first ladder section, as measured in said depthwise direction of said first ladder section;

said pivot means of each said hinge assembly which connects said second foldable section and said third foldable section of said first ladder section being spaced away, by a second distance, from said second foldable section and said third foldable section of said first ladder section, as measured in said depthwise direction of said first ladder section, said second distance being greater than said first distance.

12. A foldable extension ladder according to claim 11, wherein:

said second ladder section includes a first foldable section, a second foldable section and a third foldable section, hingedly connected together in order;

said third foldable .section of said first ladder section always being slidably connected with said first foldable section of said second ladder section;

said pivot means of each said hinge assembly which connects said first foldable section and said second foldable section of said second ladder section being spaced away, by a third distance, from said first foldable section and said second foldable section of said second ladder section, as measured in said depthwise direction of said second ladder section;

said pivot means of each said hinge assembly which connects said second foldable section and said third foldable section of said second ladder section being spaced away, by a fourth distance, from said second foldable section and said third foldable section of said second ladder section, as measured in said depthwise direction of said second ladder section, said fourth distance being less than said third distance.

13. A foldable extension ladder according to claim 9, wherein each said hinge means of a respective ladder section includes:

a first hinge plate having:

connecting means for connecting said first hinge plate to one end rail of one foldable section of the respective ladder section, and a pivot connecting portion extending outwardly of the respective ladder section, as measured in the depthwise direction of the respective ladder section;

a second hinge plate having:

connecting means for connecting said second hinge plate to one end rail of another adjacent foldable section of the respective ladder section, and a pivot connecting portion extending outwardly of the respective ladder section, as measured in said depthwise direction of the respective ladder section; and one said pivot pin means pivotally connects said pivot connecting portions of said first and second hinge plates together.

14. A ladder according to claim 13, wherein:

said hinge means of the respective ladder section further includes a third hinge plate having:

connecting means for connecting said third hinge plate to said one end rail of said adjacent foldable section of the respective ladder section, and a pivot connecting portion extending outwardly of the respective ladder section, as measured in said depthwise direction of the respective ladder section, said third hinge plate being in parallel, spaced apart relation to said second hinge plate so as to define a gap therebetween through which said first hinge plate can slide; and said one pivot pin means pivotally connects said pivot connecting portions of said first, second and third hinge plates together.

15. A ladder according to claim 14, wherein each said hinge plate is formed as an L-shaped plate with a lengthwise leg connected in said lengthwise direction to one end rail of a respective foldable section and a connecting leg having a component extending substantially perpendicular to said lengthwise direction, each said connecting leg containing a free end which forms said pivot connection portion of the respective hinge plate.

16. A ladder according to claim 13, wherein said first hinge plate includes a first lock opening and said second hinge plate includes a second lock opening in alignment with said first lock opening when said ladder section is in said in-line configuration; and said locking means includes pin means for releasably engaging in said first and second lock openings when said ladder section is in said in-line configuration to releasably lock said ladder section in said in-line configuration.

17. A ladder according to claim 16, wherein said locking means further includes spring biasing means for biasing said pin means into engagement with said first and second lock openings, and holding means for releasably holding said pin means out of engagement with said first and second openings against the force of said spring means.

18. A ladder according to claim 9, further including releasable engagement means for releasably locking said first and second ladder sections in a desired one of various sliding positions relative to each other.

19. A ladder according to claim 9, wherein the rungs of said first section have a first length and the rungs of said second section have a second length less than said first length such that said second section can slide within said first section.

20. A ladder according to claim 9, wherein the rungs of said first and second sections have substantially equal lengths such that said second section can slide along said first section.

21. A ladder according to claim 9, wherein said means for slidably connecting includes hook means, connected with one said end rail, for slidably engaging the other said end rail.

22. A ladder according to claim 9, wherein said means for slidably connecting includes hook means for slidably engaging both end rails.

* * * * *

UNITED STATES PATENT AND TRADEMARK OFFICE

CERTIFICATE OF CORRECTION

PATENT NO. : 5,350,038
DATED : September 27, 1994
INVENTOR(S) : Jonathan F. Lazarus It is certified that error appears in the above-indentified patent and that said Letters Patent is hereby corrected as shown below:

Column 19, line 23, change "an" to --and--.

Column 20, line 39, after "foldable" cancel ".".

Column 21, line 9, cancel "pin";

line 26, cancel "pin".

Signed and Sealed this

Tenth Day of January, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,350,038

DATED : SEPTEMBER 27, 1994

INVENTOR(S) : JONATHAN F. LAZARUS

It is certified that error appears in the above-indentified patent and that said Letters Patent is hereby corrected as shown below:

Column 18, line 14, change "24" to --1--.

Column 19, line 10, change "24" to --1--.

Signed and Sealed this

Eighteenth Day of July, 1995

*Attest:*

Bruce Lehman

BRUCE LEHMAN

*Attesting Officer*

*Commissioner of Patents and Trademarks*